US006657188B1

(12) United States Patent
Hulet et al.

(10) Patent No.: US 6,657,188 B1
(45) Date of Patent: Dec. 2, 2003

(54) METHOD AND APPARATUS FOR MAGNETICALLY GUIDING NEUTRAL PARTICLES

(76) Inventors: Randall Gardner Hulet, 3734 Garnet St., Houston, TX (US) 77005; Kevin Edwin Strecker, 7575 Cambridge St. #1904, Houston, TX (US) 77054; Jordan Mitchell Gerton, 1735 Albans, Houston, TX (US) 77005; William Ian McAlexander, 833 W. Holland, Fresno, CA (US) 93705; Curtis Charles Bradley, Texas Christian University TCU Box 298840, Fort Worth, TX (US) 76129; Jeffrey J Tollett, 2230 MacArthur, Houston, TX (US) 77030; Charles Ackley Sackett, 3835 Talisman Pl., Apt D, Boulder, CO (US) 80301; Bita Ghaffari, 3456 Richard St., Ann Arbor, MI (US) 48104; Stephen Calvin Moss, 173 Piedra Loop, Los Alamos, NM (US) 87544

( * ) Notice: Subject to any disclaimer, the term of this patent is extended or adjusted under 35 U.S.C. 154(b) by 0 days.

(21) Appl. No.: 09/640,639

(22) Filed: Aug. 17, 2000

Related U.S. Application Data

(60) Provisional application No. 60/149,631, filed on Aug. 17, 1999, and provisional application No. 60/171,322, filed on Dec. 21, 1999.

(51) Int. Cl.[7] ..... H05H 3/02; G21C 11/00
(52) U.S. Cl. ..... 250/251; 250/515.1
(58) Field of Search ..... 250/281, 505.1, 250/251, 781, 515.1; 378/145, 149

(56) References Cited

U.S. PATENT DOCUMENTS 3,591,800 A * 7/1971 Kartaschoff ..... 250/41.3
4,348,765 A * 9/1982 Oettinger ..... 372/78
5,589,009 A * 12/1996 Kim et al. ..... 148/302
6,054,708 A * 4/2000 Shimizu ..... 250/251
6,303,928 B1 * 10/2001 Buell et al. ..... 250/251

FOREIGN PATENT DOCUMENTS

DE 3817635 * 12/1989 ..... 250/281

OTHER PUBLICATIONS

"Efficient magnetic guiding and deflection of atomic beams with moderate velocities" authored by Goepfert et al, Appli. Phys. B (69),217–222 (1999).*

"Trapping and Focusing Ground State Atoms with Static Fields" authored by Ketterle et al, Appli. Phys. B (54), 403–406 (1992).*

Tollett J.J. et al. Permanent magnet trap for cold atoms. *Physical Review A*, 1995, 51: R22–5.

Halbach K. *Nucl. Instrum. Meth.*, 1980, 169: 1.

(List continued on next page.)

*Primary Examiner*—John R. Lee
*Assistant Examiner*—Kalimah Fernandez
(74) *Attorney, Agent, or Firm*—Brenda K. Mann

(57) ABSTRACT

Neutral particles, such as atoms and molecules, transported along a path having at least one curved region are selectively conveyed or filtered according to each particle's velocity by generating an inhomogeneous magnetic field across a cross-section of the path. The neutral particles may be transported through a physical tube or simply through the region defined by the magnetic field. The path may have more than one curved region and may additionally have one or more straight regions. The magnetic field may be generated for example by homogeneously or inhomogeneously magnetized permanent magnets or by current carrying elements. The magnetic elements may additionally be used in conjunction with at least one piece of a high permeability magnetic material for focussing or containing the magnetic field.

40 Claims, 3 Drawing Sheets

OTHER PUBLICATIONS

Ghaffari B. et al. Laser–free slow atom source. *Physical Review A*, 1999, 60: 3878–81.
Ritchie N.W.M. et al. Trap loss collisions of 7Li: The role of trap depth. *Laser Physics*, 1994, 4: 1066–75.
Ritchie N.W.M. et al. Trap–loss collisions of ultracold lithium atoms. *Physical Review A*, 1995, 51: R890–3.
Miers R.E. et al. Narrow–band velocity selector for neutral particles. *Rev. Sci. Instrum.*, 1988, 59: 1303–6.
Phillips W.D., Metcalf H. Laser deceleration of an atomic beam. *Physical Review Letters*, 1982, 48: 596–9.
Ketterle W. et al. High densities of cold atoms in a dark spontaneous–force optical trap. *Physical Review Letters*, 1993, 70: 2253–6.
Monroe C. et al. Very cold trapped atoms in a vapor cell. *Physical Review Letters*, 1990, 65: 1571–4.
Gibble K.E. et al. Improved magneto–optic trapping in a vapor cell. *Optics Letters*, 1992, 17: 526–8.
Myatt C.J. et al. Production of two overlapping Bose–Einstein condensates by sympathetic cooling. *Physical Review Letters*, 1997, 78: 586–9.

Cable A. et al. Observations of sodium atoms in a magnetic molasses trap loaded by a continuous uncooled source. *Optics Letters*, 1990, 15: 507–9.

Anderson B.P., Kasevich M.A. Enhanced loading of a magneto–optic trap from an atomic beam. *Physical Review A*, 1994, 50: R3581–4.

Meschede D. et al. Atom optics with permanent magnetic components. *SPIE*, 1997, 2995: 191–7.

Goepfert A. et al. Efficient magnetic guiding and deflection of atomic beams with moderate velocities. *Applied Physics B*, 1999, 69:217–22.

* cited by examiner

METHOD AND APPARATUS FOR MAGNETICALLY GUIDING NEUTRAL PARTICLES

The present application claims priority of U.S. Provisional Application Ser. No. 60/149,631 filed Aug. 17, 1999 and U.S. Provisional Application Ser. No. 60/171,322 filed Dec. 21, 1999. The entire text of each of the above-referenced disclosures is specifically incorporated by reference herein without disclaimer.

This invention was supported in part by grants from the National Science Foundation under grant numbers PHY-9512688 and PHY-9732632, the National Aeronautics and Space Administration under grant numbers NAG3-1851 and NAG8-1444, and the U.S. Office of Naval Research under grant number N00014-98-1-0699.

BACKGROUND OF THE INVENTION

1. Field of the Invention

The present invention relates to a magnetic velocity selector for passively selecting slow neutral particles, such as atoms, molecules, or neutrons, from a source having both slow and fast neutral particles. In particular, the present invention uses a magnetic field placed along a curve as a low-pass or band-pass velocity filter to provide a source of slow or monoenergetic neutral particles for such purposes as loading traps, producing a beam of coherent particles (e.g. "atom laser"), directly depositing particles onto surfaces, and for applications such as time and frequency standards (e.g. atomic clocks), spectroscopy, particle-surface scattering measurements, particle interferometers, crystallography, and particle scattering studies.

2. Description of Related Art

Given the widespread importance of slow or monoenergetic neutral particle sources, much effort has been dedicated to improving their performance and especially to their simplification. Mechanical velocity selection of particle beams has been a standard method for producing narrow velocity distributions, particularly for crossed molecular beam and neutron beam scattering experiments [1]. Methods employed for mechanical velocity selection typically use the motion of some assembly to physically block particles moving outside of a specified range of velocities. Examples of these assemblies include sets of rotating slotted disks, spinning grooved plates or cylinders, and rotating helical fins. Transmitted particles move through the moving assembly without physically contacting it, while blocked particles reflect or stick to the assembly surfaces that move across their path. The main disadvantages of these methods are that these devices (1) are extremely complex, (2) require rapidly moving parts inside of the vacuum, and (3) produce small total efficiencies for slow atoms. The present invention is much simpler, more economical, and more efficient, and more compatible with vacuum technology Atom traps, which are widely used for both scientific and technological applications, are loaded from sources of slow atoms. Lasers have been used to actively slow the fast atoms in a beam, thereby compressing the velocity distribution and increasing the flux of slow atoms. Laser methods require no mechanical components to be placed in the vacuum region. Trap loading methods that rely on laser slowing an atomic beam, therefore, can achieve high load rates and low background pressures, resulting in long trap lifetimes. Zeeman slowing [2] is the most successful of these techniques, providing typical load rates of $10^8$ atoms/s into a magneto-optical trap (MOT). Under optimum conditions, rates as high as $10^{11}$ atoms/s have been attained [3]. Unfortunately, this method is complex and expensive since it usually requires acousto-optical and/or electro-optical modulators, and significant laser power. Additionally, the slowed atomic beam expands transversely as it propagates away from the beam source, leading to a decrease in the beam intensity. Finally, laser slowing methods are not useful for molecular beams because the internal structure of molecules is much more complicated than for atoms. In contrast to laser slowing, the present invention is not comprised of lasers or other optical devices and the invention can be used to produce a beam of slow or monoenergetic molecules or neutrons.

MOTs have also been directly loaded from the slow atoms present in a vapor cell [4]. The main advantage of vapor loading lies in its simplicity since no additional laser beams, other than those used for trapping, are required. Load rates as high as $10^{11}$ atoms/s have been achieved in vapor cells [5], though the relatively high background gas pressure results in reduced trap lifetimes that prove unsuitable for many applications. This limitation encouraged the development of the double-MOT scheme. In this technique, the trapped atoms from a vapor-loaded MOT are transferred to an ultra-high vacuum (UHV) chamber using magnetic guiding, providing load rates of ~$10^8$ atoms/s [6]. The main disadvantage of this method, as for Zeeman slowing, is the degree of complexity and expense. MOTs have also been loaded directly from a thermal atomic beam [7], achieving load rates of ~$10^7$ atoms/s from an oven located ~20 cm from the trap [8]. Although simple, this method suffers from reduced trap lifetimes resulting from the proximity of the relatively high-pressure atomic source. Applications that require less than maximal particle flux, but must be UHV-compatible, may benefit from a simple technique that does not involve lasers, such as the one described here.

Myatt et al. [6] previously used magnetic fields to guide already slow atoms from one MOT to another. Meschede et al. [9] and Goepfert et al. [10] used a combination of light forces and permanent magnets to deflect the laser-slowed atoms out of an atomic beam. In their work, a Zeeman-slowing system is used to create slow atoms and a transverse laser beam optically deflects the atomic beam. The major conceptual improvement over the work of Myatt, Meschede, and Goepfert which the present invention provides, is the complete lack of laser manipulation of the atomic beam. In the present invention, neutral particles are passively selected according to their velocity. Furthermore, since the neutral particles are passively selected, the particles are in the ground state and there is no spontaneous emission as occurs with laser slowing. Therefore, the quantum mechanical state of the particle is preserved. The present invention provides an exceptionally simple, economical and robust alternative to laser cooling methods.

SUMMARY OF THE INVENTION

According to the invention, neutral particles, such as atoms and molecules, are selectively conveyed or filtered according to each particle's velocity as the neutral particles are transported along a path having at least one curved region by generating an inhomogeneous magnetic field across a cross-section of the path. The neutral particles may be transported through a physical tube or simply through the region defined by the magnetic field. The path may have more than one curved region and may additionally have one or more straight regions. In one embodiment of the invention, the magnetic field is generated by homogeneously or inhomogeneously magnetized permanent magnets. In another embodiment of the invention, the magnetic field is generated by wires. In another embodiment of the invention, the magnetic field is generated by current conducting elements which have been deposited on a surface using lithographic and/or deposition techniques. Additionally, magnetic materials or yokes may be used in order to focus and contain the magnetic field lines.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS

Figures 1A, 1B:
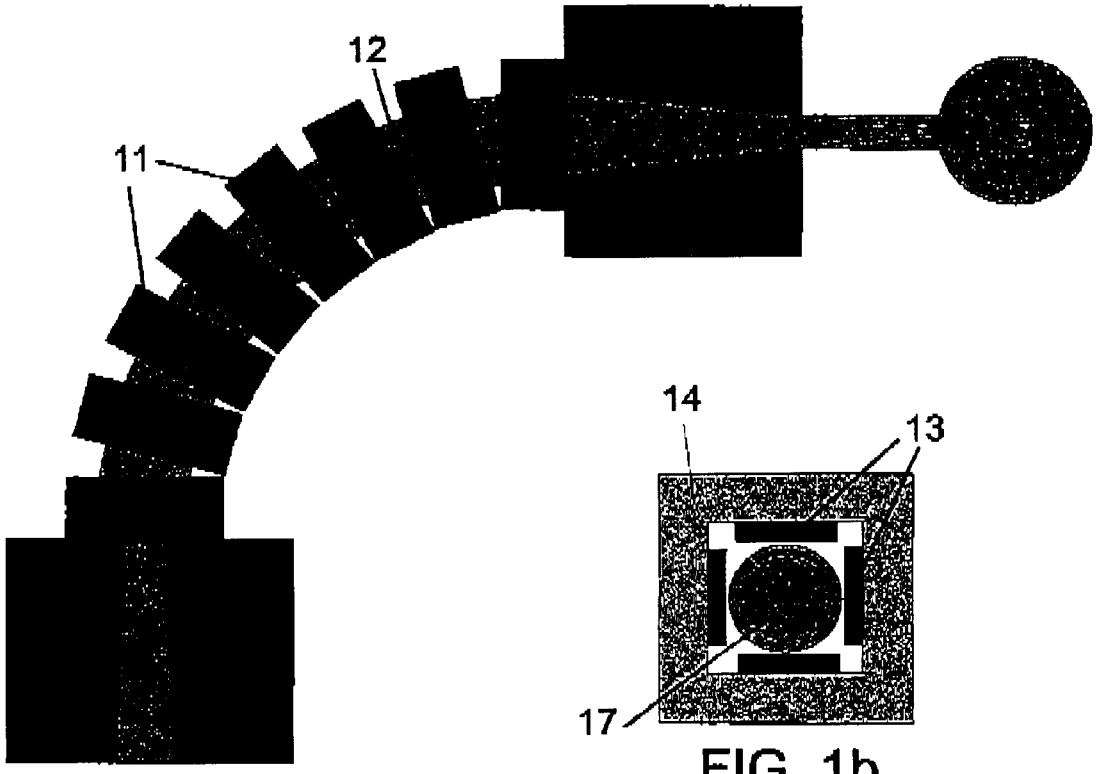
FIG. 1*a* is a schematic of a magnetic velocity selector utilizing a quadrupole field.
FIG. 1*b* is a schematic of a cross-sectional view of one set of quadrupole magnets.

The velocity selector of the present invention passively conveys neutral particles, such as atoms and molecules, that are below a threshold velocity while filtering neutral particles that are above the threshold velocity. This is accomplished by transporting the neutral particles along a path that has a curved region and applying an inhomogeneous magnetic field across a cross-section of the path. The orientational energy, U, of a neutral particle within an external magnetic field, $\vec{B}_{ext}$, is given by $U=-\vec{\mu}\cdot\vec{B}_{ext}$, wherein $\vec{\mu}$ is the magnetic moment of the neutral particle. Neutral particles with magnetic moments antiparallel to the field direction are preferentially driven towards regions of low field and are therefore called low-field-seekers. Since the velocity selector has a minimum in magnetic field at the center of a cross-section, neutral particles which are in low-field seeking states will be guided, or conveyed, while those in high-field seeking states will be driven away from the center of the cross-section and lost from the beam, or filtered. Furthermore, the field gradient provides the centripetal force needed to guide slow particles around the curve, while faster particles are unable to follow the curved trajectory and are filtered.

Another way of stating this is that neutral particles that are slower than a threshold velocity are successfully guided. Faster neutral particles, however, do not follow the curved path and are lost from the beam. The threshold velocity is determined by the radius of curvature of the path, the mass of the neutral particles, and the strength of the magnets. A rough estimate for the threshold velocity, $v_{th}$, may be obtained by equating the magnetic force with the centripetal force necessary for neutral particles to traverse the curve, $\mu\nabla B=mv_{th}^2/R$, where $\mu$ is the magnetic moment, m is the mass, $\nabla B$ is the magnetic field gradient, and R is the radius of curvature of the path. Although the curve might not be a circular arc, any differential length of the curve will closely approximate a circular arc. The above equation, therefore, provides an estimate of $v_{th}$ for each differential length of the path.

The magnetic field gradient desired in each case may be determined according to the equation given above from the threshold velocity required and the mass of the neutral particle. The magnetic field may be generated by homogeneously or inhomogeneously magnetized permanent magnets, by wires carrying an electrical current, or by another method such as by depositing current-carrying conductors on substrates such as by lithographic and/or deposition techniques, by depositing magnetic thin films on substrates such as by lithographic and/or deposition techniques, or by combinations of current carrying elements and magnetic elements such as described above, or by combinations of current carrying elements such as described above and magnetic materials which confine and/or focus the magnetic field lines and therefore enhance the magnetic field gradient. Elements for generating the magnetic field, such as described above, may be made of any material which will give the appropriate magnetic field strength and will be known to those of skill in the art. Arrangements of the magnetic generating elements which may be used in the present invention will also be known to those with skill in the art.

It may be particularly useful to employ the use of magnetic yokes in order to shunt the magnetic field lines, which reduces stray fields. The yokes may also flatten the magnetic field profile, thereby widening the entrance for slow neutral particles. Other benefits of the shunt yokes include enhancing the magnetic field strength (~50% increase for Example 2 below), and providing a surface for the magnetic elements to be conveniently affixed in the appropriate positions. The yokes may be made of any material with a high magnetic permeability, such as magnetic stainless steel alloys or iron.

The neutral particles may be transported along the path through a tube. However, a physical tube is not necessary; the neutral particles may simply travel along the path as defined by the magnetic field generated. However, a tube may be advantageous as it may provide a conduction limit between the input and output ends of the velocity selector, which may be useful for isolating a low-vacuum chamber from a high-vacuum chamber. Since the conduction, C, is on the order of $D^3/L$, where D is the diameter of the tube and L is the length of the tube, a longer, narrower tube reduces conduction. This leads to more complete pressure isolation of, for instance, a high-vacuum chamber at the outlet of the velocity selector, since a smaller conduction leads to a smaller rate of gas flow Q from the higher pressure chamber to the lower pressure chamber: $\Delta P=Q/C$, where $\Delta P$ is the difference in pressure. Additionally, when a tube is used, the magnets can be put outside of the vacuum chamber and the magnets do not need to be vacuum compatible. It also allows the vacuum tube to be baked, leading to a better vacuum.

The path, or tube, may have more than one substantially curved region. The path, or tube, may additionally have one or more substantially straight regions. The radius of curvature of the path desired may be determined in each case from the threshold velocity required and the magnetic field gradient according to the equation above for the threshold velocity. When a physical tube is utilized, the tube may be made of any material compatible with the specific application, and will be known to those of skill in the art. For example, when atoms are passively selected by the present invention while being transported from a source to a MOT, it is particularly useful that the tube be made of a vacuum-compatible material such as stainless steel or aluminum.

The source of neutral particles leading into the inlet of the velocity selector may be any gaseous source of neutral particles wherein the neutral particles have a distribution of velocities. For example, the neutral particles may derive from a thermal source, such as an oven with an aperture, or from a supersonic beam source.

The velocity selector, or guiding system, of the present invention can be viewed as a particle-optical element that performs as a low-pass velocity filter. The present invention may also be used as part of a band-pass filter for delivery of a mono-energetic beam of neutral particles, such as atoms, molecules, or neutrons, for applications such as crystallography, or direct deposition of particles on surfaces. This device may also be used for directly loading a magnetic trap based on permanent magnets [11] since its capture velocity is much greater than that of a MOT. Since the velocity selector is simple and robust, it may be well-suited for space-borne applications, particularly with the use of permanent magnets that require no electrical power consumption. Furthermore, the apparatus is inexpensive. The performance of the velocity selector of the present invention represents a significant improvement in the design of sources of slow neutral particles.

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

EXAMPLE 1

One embodiment of the present invention is shown in FIG. 1*a* while FIG. 1*b* shows a cross-section of the path of the velocity selector. The velocity selector is comprised of eight sets of four permanent magnets 11 arranged around a curved vacuum nipple 12 made of stainless steel. The four magnets 13 of each set are arranged in a quadrupole configuration and sit in an iron yoke 14 which reduces field fringing. The magnets in this case are made of neodymium iron boron. They have an 11 kilo-Gauss (kG) residual induction and measure 0.100×0.270×0.720 inches. They have been spray-painted to protect them from oxidation and corrosion. They may be metal-plated, if necessary, to enhance vacuum compatibility. The residual induction is the specified magnetic induction within the permanent magnet, providing a measure of the strength of the magnet. In this case, lithium atoms are provided by a lithium oven 15 and pass into a source vacuum chamber 16 before entering the velocity selector. The slow atoms 17 conveyed by the velocity selector then travel into a trap vacuum chamber 18.

Figure 2:
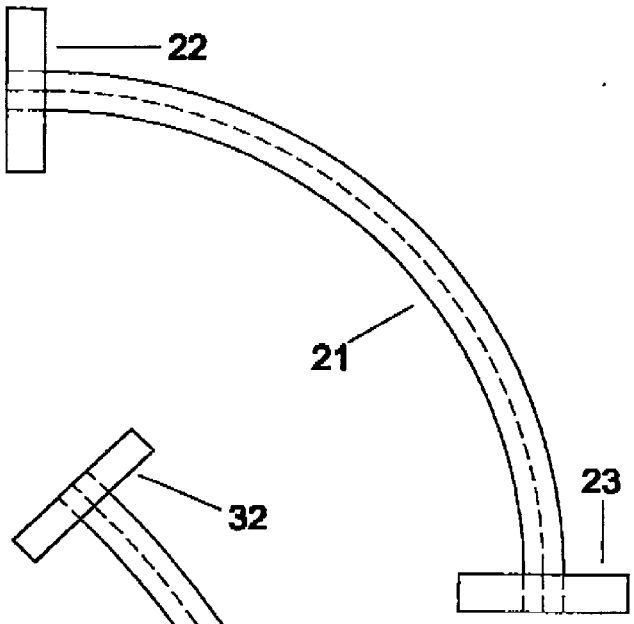
FIG. 2 is a schematic of a curved portion of a magnetic velocity selector with a 10 cm bend radius.
Figure 3:
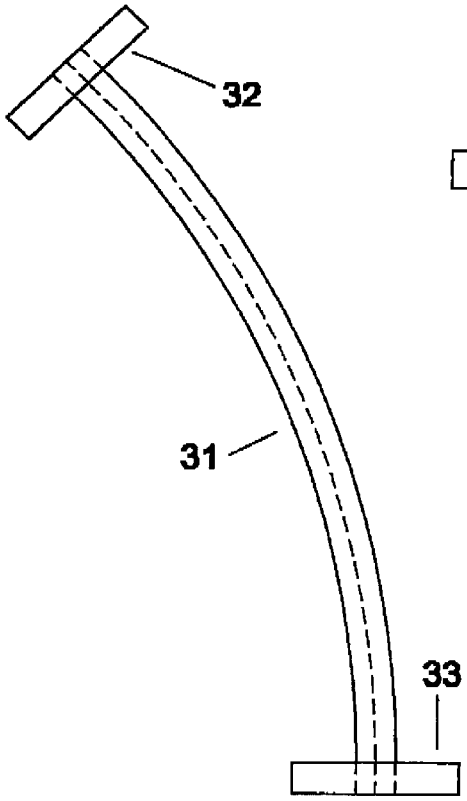
FIG. 3 is a schematic of a curved portion of a magnetic velocity selector with a 20 cm bend radius.
Figure 4:
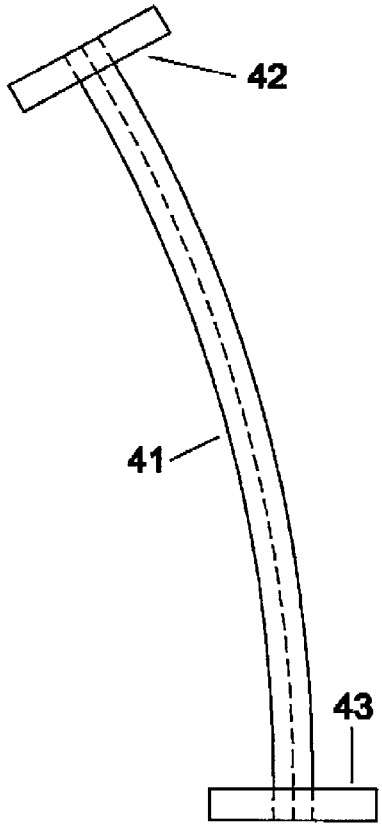
FIG. 4 is a schematic of a curved portion of a magnetic velocity selector with a 30 cm bend radius.

Various curved nipples have been used in transporting the atoms. FIG. 2 shows a 90° nipple with a bending radius of 10 cm. The tube 21 measures 0.3125" OD, 0.25" ID, and 6.2" in length. One end has a rotatable tapped 1.33" Conflat flange 22. The other end has a rotatable (not tapped) 1.33" Conflat flange 23. FIG. 3 shows a nipple with a bend angle of 45° and a bending radius of 20 cm. The tube 31 has the same measurements as the tube 21 in FIG. 2. Again, one end has a rotatable tapped 1.33" Conflat flange 32, while the other end has a rotatable (not tapped) 1.33" Conflat flange 33. FIG. 4 shows a third nipple with a bend angle of 30° and a bending radius of 30 cm. The tube 41 has the same measurements as the tube 21 in FIG. 2. Again, one end has a rotatable tapped 1.33" Conflat flange 42, while the other end has a rotatable (not tapped) 1.33" conflat flange 43.

The field produced inside one of the quadrupole sets of magnets was measured on a cross section using a 3-D Hall probe. The magnetic field gradient, $B_0$, is approximately the same in both the x and y directions, and the magnetic field has the form $\vec{B}=B_0(x\hat{x}-y\hat{y})$. Along y=0, which corresponds to the bending plane of the velocity selector nipple, $B_0$=1.2 kG/mm and the maximum field produced at the inner edge of the curved nipple is ~3.8 kG.

As previously mentioned, the orientational energy of an atom within an external magnetic field is given by $U=-\vec{\mu}_{atom}\cdot\vec{B}_{ext}$. Since the velocity selector has a minimum in magnetic field at the center of a cross-section, atoms which are in low-field seeking states will be guided, or conveyed, while those in high-field seeking states will be driven to the inner wall of the velocity selector and lost from the beam, or filtered. The magnetic moment of the atoms which are guided is $\mu_{atom}\cong\mu_B$, where $\mu_B$ is the Bohr magneton.

EXAMPLE 2

Figures 5A, 5B:
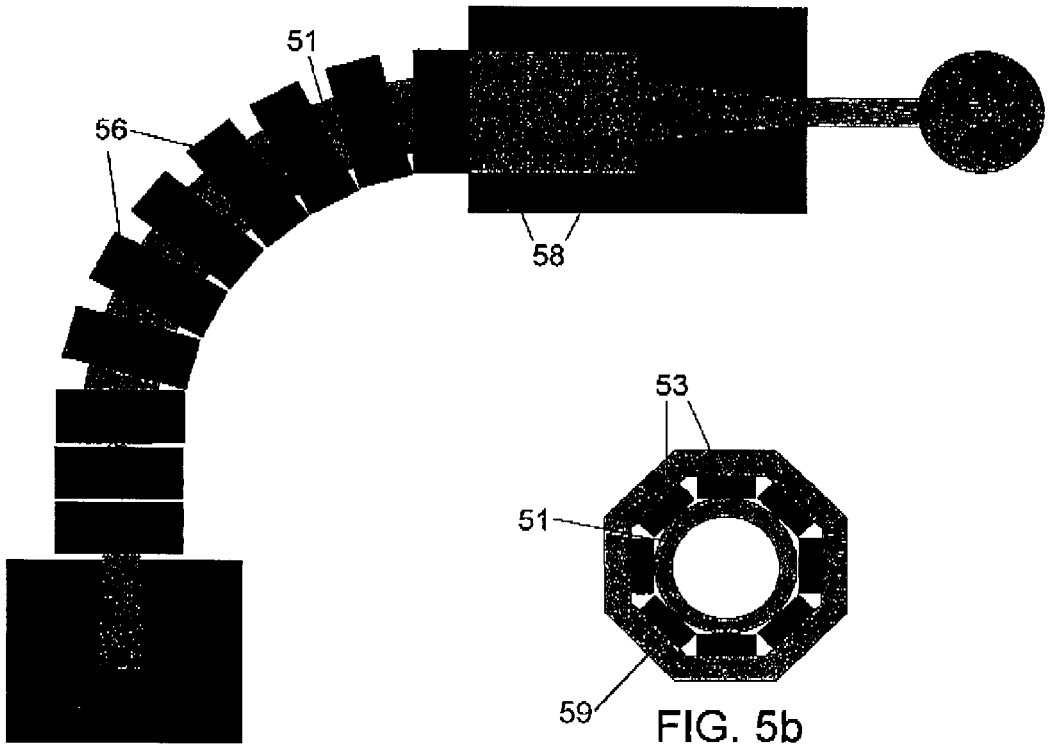
FIG. 5*a* is a schematic of a magnetic velocity selector utilizing an octupole field.
FIG. 5*b* is a schematic of a cross-sectional view of one set of octupole magnets.

Another embodiment of the present invention is shown in FIG. 5*a*, wherein the slow atoms present in a thermal lithium beam were magnetically transported to a MOT. FIG. 5b shows a cross-section of the path of the velocity selector shown in FIG. 5*a*. The lithium atoms are transported through a curved, conduction-limited tube 51, allowing the trap vacuum chamber 52 to be differentially pumped to UHV pressures. Permanent rare-earth magnets 53 are placed outside the vacuum region around the tube to establish an octupole magnetic guiding field leading from the atomic source 54 to the MOT 55. The octupoles around the curved tube are constructed from eight NdFeB magnets 56, since this material provides the largest fields. The tube 51 inner diameter is 1.1 cm and the total arc length is 25 cm, corresponding to a conduction of ~0.4 L/s. The entrance solid angle for the thermal beam is improved by extending the octupole field inside the source chamber 57. The additional octupoles are made from SmCo magnets 58, because their relatively high Curie temperature allows them to be vacuum baked with the chamber. Each octupole set of magnets is mounted inside cylindrical housings, or yokes, 59 composed of a material with a high magnetic permeability, 400 series stainless steel in this case.

The field profile for the octupole design is flat over a larger range near the tube axis and has a higher gradient near the tube walls than the quadrupole design used in Example 1. The nearly uniform, low-field region near the axis allows a larger fraction of the slowest atoms to enter the velocity selector, since the magnetic potential is lower over a larger fraction of the tube. Additionally, the higher gradient near the walls leads to a higher threshold velocity for guiding. More ideal N-pole fields can be produced by using a multiple of N magnetic elements, such as 2N, 3N, etc. [12].

The number of trapped atoms in the MOT was determined by observing the excited state fluorescence with a photodiode. The load rate is measured by first emptying the MOT of all atoms and then observing the increase in fluorescence during the first few seconds after the atomic beam is unblocked. Load rates of ~$6\times10^6$ atoms/s and peak numbers of ~$2\times10^8$ atoms are obtained.

A Monte-Carlo calculation was also performed to model the efficiency of the velocity selector. The trajectory of atoms through the velocity selector is calculated to determine whether they are transmitted to the exit. All parameters for the calculation, including those which describe the velocity selector as well as those which describe the initial position and velocity distribution of the atoms upon entering the velocity selector, are consistent with the experiment [13]. A rough estimate for the threshold velocity, $v_{th}$, can also be obtained as described previously. If $\nabla B$ is taken to be half the gradient at the tube wall, $v_{th} \cong 110$ m/s, in agreement with the Monte-Carlo model. To calculate the expected MOT load rate, the magnetic field is assumed to suddenly go to zero at the velocity selector exit, and the atomic trajectories are extended to the trap region. Atoms that pass through the trap volume with speeds less than or equal to the capture velocity are assumed trapped. Using previous calculations of Li atom trajectories in a MOT [14,15], we estimate the capture velocity to be 30–40 m/s for the present trap parameters. This velocity range corresponds to load rates between $2\times10^6$ and $7\times10^6$ atoms/s, which is consistent with the measured load rate of $\sim6\times10^6$ atoms/s. The flux of slow atoms could be increased by using a less collimated atomic beam that would completely fill the entrance solid angle of the velocity selector.

All of the methods and apparatus disclosed and claimed herein can be made and executed without undue experimentation in light of the present disclosure. While the methods of this invention have been described in terms of preferred embodiments, it will be apparent to those of skill in the art that variations may be applied to the methods and apparatus and in the steps or in the sequence of steps of the method described herein without departing from the concept, spirit and scope of the invention. More specifically, it will be apparent that certain materials which are related may be substituted for the materials described herein while the same or similar results would be achieved. All such similar substitutes and modifications apparent to those skilled in the art are deemed to be within the spirit, scope and concept of the invention as defined by the appended claims.

REFERENCES

The following references, to the extent that they provide exemplary procedural or other details supplementary to those set forth herein, are specifically incorporated herein by reference.

[1] R. E. Miers, R. W. York, and P. T. Pickett, "Narrow-band velocity selector for neutral particles," Rev. Sci. Instrum. 59 (8), 1303–1306 (1988).

[2] W. D. Phillips and H. Metcalf, "Laser Deceleration of an Atomic Beam," Physical Review Letters 48 (9), 596–599 (1982).

[3] Wolfgang Ketterle, Kendall B. Davis, Michael A. Joffe et al., "High Densities of Cold Atoms in a Dark Spontaneous-Force Optical Trap," Physical Review Letters 70 (15), 2253–2256 (1993).

[4] C. Monroe, W. Swann, H. Robinson et al., "Very Cold Trapped Atoms in a Vapor Cell," Physical Review Letters 65 (13), 1571–1574 (1990).

[5] Kurt E. Gibble, Steven Kasapi, and Steven Chu, "Improved magneto-optic trapping in a vapor cell," Optics Letters 17 (7), 526–528 (1992).

[6] C. J. Myatt, E. A. Burt, R. W. Ghrist et al., "Production of Two Overlapping Bose-Einstein Condensates by Sympathetic Cooling," Phys. Rev. Lett. 78, 586–589 (1997).

[7] A. Cable, M. Prentiss, and N. P. Bigelow, "Observations of sodium atoms in a magnetic molasses trap loaded by a continuous uncooled source," Optics Letters 15 (9), 507–509 (1990).

[8] B. P. Anderson and M. A. Kasevich, "Enhanced loading of a magneto-optic trap from an atomic beam," Physical Review A 50 (5), R3581–3584 (1994).

[9] D. Meschede, I. Bloch, A. Goepfert et al., "Atom Optics with Permanent Magnetic Components," SPIE 2995, 191–197 (1997).

[10] A. Goepfert, F. Lison, R. Schutze et al., "Efficient magnetic. guiding and deflection of atomic beams with moderate velocities," Appl. Phys. B 69, 217–222 (1999).

[11] J. J. Tollett, C. C. Bradley, C. A. Sackett et al., "Permanent Magnet Trap for Cold Atoms," Phys. Rev. A 51 (1), R22–R25 (1995).

[12] K. Halbach, Nucl. Instrum. Methods 169, 1 (1980).

[13] B. Ghaffari, J. M. Gerton, W. I. McAlexander et al., "Laser-Free Slow Atom Source," Physical Review A 60 (5), 3878–3881 (1999).

[14] N. W. M. Ritchie, E. R. I. Abraham, and R. G. Hulet, "Trap Loss Collisions of $^7$Li: The Role of Trap Depth," Laser Physics 4 (5), 1066–1075 (1994).

[15] N. W. M. Ritchie, E. R. I. Abraham, Y. Y. Xiao et al., "Trap-loss collisions of ultracold lithium atoms," Physical Review A 51 (2), R890–R893 (1995).

We claim:

1. A magnetic velocity selector comprising:

means for transporting a plurality of neutral particles, wherein said transporting means has at least one substantially curved region; and means for generating an inhomogeneous magnetic field across a cross-section of at least one said curved region, such that the selector conveys or filters each said neutral particle according to each said particle's velocity.

2. The selector of claim 1 wherein said neutral particles are atoms.

3. The selector of claim 1 wherein said neutral particles are molecules.

4. The selector of claim 1 wherein said transporting means is defined by a profile of said magnetic field.

5. The selector of claim 1 additionally comprising a tube through which said neutral particles are transported.

6. The selector of claim 1 wherein said transporting means additionally has at least one substantially straight region.

7. The selector of claim 1 wherein said magnetic field is a quadrupole or higher-order field.

8. The selector of claim 1 wherein said magnetic field is an octupole or higher-order field.

9. The selector of claim 1 wherein said generating means comprises a plurality of magnetic elements which are arrayed about said transporting means.

10. The selector of claim 9 wherein said magnetic elements are current carrying elements.

11. The selector of claim 9 wherein said magnetic elements are homogeneously or inhomogeneously magnetized magnets.

12. The selector of claim 9 additionally comprising at least one piece of a high permeability magnetic material for focussing or containing said magnetic field.

13. The selector of claim 12 wherein said material is iron.

14. The selector of claim 12 wherein said material is magnetic stainless steel.

15. A magnetic velocity selector comprising:

a tube for transporting a plurality of neutral particles, wherein said tube has at least one substantially curved region; and a plurality of magnetic elements which are arrayed about said tube to create an inhomogeneous magnetic field across a cross-section of at least one said curved region, such that the selector conveys or filters each said neutral particle according to each said particle's velocity.

16. The selector of claim 15 wherein said neutral particles are atoms.

17. The selector of claim 15 wherein said neutral particles are molecules.

18. The selector of claim 15 wherein said magnetic field is a quadrupole or higher-order field.

19. The selector of claim 15 wherein said magnetic field is an octupole or higher-order field.

20. The selector of claim 15 wherein said magnetic elements are current carrying elements.

21. The selector of claim 15 wherein said magnetic elements are homogeneously or inhomogeneously magnetized magnets.

22. The selector of claim 15 additionally comprising at least one piece of a high permeability magnetic material for focussing or containing said magnetic field.

23. The selector of claim 22 wherein said material is iron.

24. The selector of claim 22 wherein said material is magnetic stainless steel.

25. A method for selectively conveying first neutral particles having velocities below a threshold velocity comprising:

transporting a plurality of said first neutral particles and second neutral particles having velocities above said threshold velocity, along a path having at least one substantially curved region; and generating an inhomogeneous magnetic field across a cross-section of at least one said curved region such that said first neutral particles are conveyed and said second neutral particles are filtered.

26. The method of claim 25 wherein said first neutral particles and said second neutral particles are atoms.

27. The method of claim 25 wherein said first neutral particles and said second neutral particles are molecules.

28. The method of claim 25 wherein said magnetic field is a quadrupole or higher-order field.

29. The method of claim 25 wherein said magnetic field is an octupole or higher-order field.

30. The method of claim 25 wherein said magnetic field is generated by a plurality of magnetic elements arrayed about said path.

31. The method of claim 30 wherein said magnetic elements are current carrying elements.

32. The method of claim 30 wherein said magnetic elements are homogeneously or inhomogeneously magnetized magnets.

33. The method of claim 30 wherein said magnetic elements are used in conjunction with at least one piece of a high permeability magnetic material for focussing or containing said magnetic field.

34. The method of claim 25 wherein said first neutral particles and said second neutral particles are transported through a tube.

35. The method of claim 34 wherein said first neutral particles and said second neutral particles are atoms.

36. The method of claim 34 wherein said first neutral particles and said second neutral particles are molecules.

37. The method of claim 34 wherein said magnetic field is generated by a plurality of magnetic elements arrayed about said tube.

38. The method of claim 37 wherein said magnetic elements are current carrying elements.

39. The method of claim 37 wherein said magnetic elements are homogeneously or inhomogeneously magnetized magnets.

40. The method of claim 37 wherein said magnetic elements are used in conjunction with at least one piece of a high permeability magnetic material for focussing or containing said magnetic field.

* * * * *